United States Patent [19]

Heitmann

[11] Patent Number: 4,618,293

[45] Date of Patent: Oct. 21, 1986

[54] METHOD AND APPARATUS FOR PNEUMATICALLY TRANSPORTING ROD-SHAPED ARTICLES OF THE TOBACCO PROCESSING INDUSTRY

[75] Inventor: Bob Heitmann, Hamburg, Fed. Rep. of Germany

[73] Assignee: Hauni-Werke Körber & Co. KG., Hamburg, Fed. Rep. of Germany

[21] Appl. No.: 699,187

[22] Filed: Feb. 5, 1985

[30] Foreign Application Priority Data

Feb. 11, 1984 [DE] Fed. Rep. of Germany ..... 3404885

[51] Int. Cl.[4] ..... B65G 51/02

[52] U.S. Cl. ..... 406/28; 131/908; 406/10; 406/70; 406/83

[58] Field of Search ..... 406/10, 28, 70, 82, 406/83, 192; 131/282, 908; 198/460, 461

[56] References Cited

U.S. PATENT DOCUMENTS

| | | | |
|---|---|---|---|
| 2,761,633 | 9/1956 | Sindzinski | 406/83 X |
| 3,062,588 | 11/1962 | Molins et al. . | |
| 3,336,085 | 8/1967 | Strydom | 406/28 X |
| 3,397,922 | 8/1968 | Dearsley . | |
| 3,404,921 | 10/1968 | Vergales et al. . | |
| 3,608,972 | 9/1971 | Rudszinat . | |
| 4,337,172 | 3/1983 | Burger et al. | 406/70 X |
| 4,368,742 | 1/1983 | Wahle et al. | 406/82 X |
| 4,372,710 | 2/1983 | Kaspareu et al. | 406/28 |

FOREIGN PATENT DOCUMENTS

| | | | |
|---|---|---|---|
| 1212885 | 3/1966 | Fed. Rep. of Germany | 406/83 |
| 2306096 | 8/1974 | Fed. Rep. of Germany . | |
| 2140379 | 11/1984 | United Kingdom | 406/83 |

*Primary Examiner*—Jeffrey V. Nase

*Attorney, Agent, or Firm*—Peter K. Kontler

[57] ABSTRACT

The pneumatic conveyor pipe which connects an article discharging station with an article receiving station in a production line for rod-shaped smokers' products passes through the sealed housing of an article influencing unit which contains friction wheels driven at a peripheral speed which ensures acceleration or deceleration of successive axially moving articles to a selected speed. The thus influenced articles are thereupon accelerated by compressed air so that they are separated from each other by gaps of preselected minimum width to allow for unobstructed changes in the direction of movement of articles which arrive at the receiving station.

12 Claims, 1 Drawing Figure

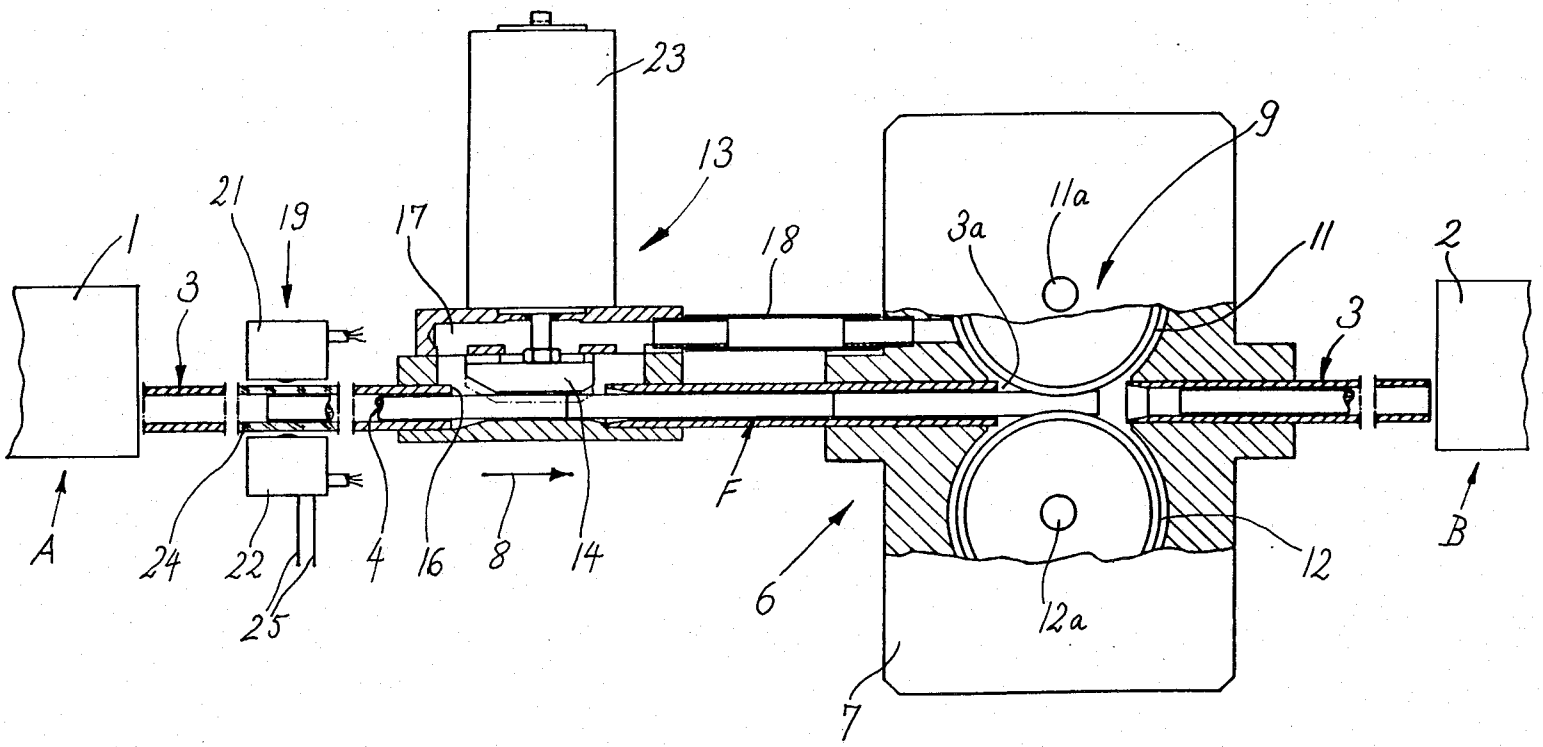
2
B
3
11
12
9
11a
12a
3a
7
6
18
F
13
23
14
8
16
17
4
19
25
21
22
24
3
1
A

METHOD AND APPARATUS FOR PNEUMATICALLY TRANSPORTING ROD-SHAPED ARTICLES OF THE TOBACCO PROCESSING INDUSTRY

BACKGROUND OF THE INVENTION

The present invention relates to a method of and to an apparatus for transporting rod-shaped articles of the tobacco processing industry, especially for transporting sections of filter rods. More particularly, the invention relates to a method of and to an apparatus for pneumatically transporting rod-shaped articles of the tobacco processing industry axially between an article discharging station (known as a sender) and an article receiving station (known as a receiver) by way of a pneumatic conveyor wherein the articles are advanced by a compressed gaseous carrier medium, normally air.

It is well known to transport rod-shaped articles of the tobacco processing industry from an article discharging station (such station can receive articles from one or more magazines or one or more makers) to one or more remote receiving stations (e.g., to the magazine or magazines of one or more processing machines) by way of a pneumatic conveyor pipe wherein the articles are propelled by compressed air. It is also known to provide in the conveyor pipe means for ensuring that the articles are singularized prior to arrival at the receiving station, namely that successive articles are separated from each other by gaps of prescribed width. This is desirable and necessary because, upon arrival at the receiving station, the articles are frequently caused to switch from axial movement to a movement at right angles to their axes. In the absence of gaps between successive articles, the next-following articles could interfere with sidewise transport of the immediately preceding articles and any frictional and/or other contact between such articles (e.g., between the front end face of the trailing article and the rear end face of the preceding article) could result in deformation, other damage or total destruction.

In modern high-speed production lines for the making of filter cigarettes or the like, the frequency at which successive rod-shaped articles (coming, for example, from a filter rod making machine or from a magazine for filter rod sections) are propelled into the inlet of a pneumatic conveyor pipe is so high that the kinetic energy of pneumatically propelled articles is quite pronounced. Therefore, it is even more important to prevent undesirable contact between successive articles at the time a preceding article is caused to change the direction of its movement because such contact would be practically certain to result in substantial damage to both articles, in clogging of the receiving station and in substantial losses in output. Attempts to uniformize the speed of successive articles in the conveyor pipe by braking devices have failed to remedy the situation because, if the braking force is sufficiently high to ensure adequate deceleration of rapidly advancing articles, the braking member or members are likely to damage or destroy such articles. On the other hand, if the braking action is less pronounced, the articles are likely to advance past and beyond the braking member or members without adequate deceleration so that such articles strike against the trailing ends of the preceding articles and interfere with proper singularization as well as with proper changes in the direction of movement of successive articles at the receiving station. It has been found that many articles advance past and beyond the braking member or members practically without any deceleration. Such unbraked or insufficiently braked articles rapidly catch up with the preceding articles and invariably interfere with the singularization of articles ahead of as well as with deflection of articles at the receiving station. Excessive braking is equally undesirable because the wrappers of the articles are likely to undergo permanent deformation or to be destroyed on contact with the braking member or members.

Additional problems arise when the transporting system employs a relatively long pneumatic conveyor pipe which includes straight as well as arcuate portions. The articles in such conveyor pipes are likely to pile up into one or more long or very long series of abutting articles (the so-called D-trains) which advance at a relatively low speed and must be broken up ahead of the receiving station in order to prevent the development of bottlenecks.

OBJECTS AND SUMMARY OF THE INVENTION

An object of the invention is to provide a novel and improved method of pneumatically transporting rod-shaped articles of the tobacco processing industry axially between two spaced-apart stations in such a way that the articles are transported at an elevated speed (i.e., large numbers of articles are transported per unit of time) but without any deformation and/or other damage to the conveyed articles.

Another object of the invention is to provide a method which can be resorted to for breaking up the so-called D-trains which accumulate in elongated pneumatic conveyor pipes.

A further object of the invention is to provide a method which ensures adequate singularization of rod-shaped articles ahead of the receiving station irrespective of the speed at which the articles are propelled into the pneumatic conveyor pipe.

An additional object of the invention is to provide a novel and improved apparatus for the practice of the above outlined method and to construct and assemble the apparatus in such a way that it can treat the atticles gently and can compensate for fluctuations in the rate of transport of articles from the article discharging to the article receiving station.

Another object of the invention is to provide the apparatus with novel and improved means for influencing the articles in the pneumatic conveyor pipe between the discharging and receiving stations.

A further object of the invention is to provide the apparatus with novel and improved means for accelerating the articles in the pneumatic conveyor pipe ahead of the receiving station.

An additional object of the invention is to provide an apparatus which can be installed in existing production lines for rod-shaped smokers' articles as a superior substitute for heretofore known article transporting apparatus.

One feature of the invention resides in the provision of a method of transporting rod-shaped articles of the tobacco processing industry axially between an article discharging station and an article receiving station along an elongated path which is defined by a pneumatic conveyor pipe. The method comprises the steps of propelling a series of successive articles from the discharging station into the elongated path, mechanically influencing the speed of successive articles of the series in a first portion of the path ahead of the receiving station so that each of the thus influenced articles advances at a predetermined speed and the articles form a file of closely adjacent articles extending from the first portion of the path upstream toward the article discharging station, and pneumatically accelerating successive foremost articles of the file in a second portion of the path downstream of the first portion (i.e., between the first portion and the receiving station) so as to establish gaps between successive accelerated articles and the next-following articles of the file. The influencing step includes accelerating or decelerating successive articles of the series. The articles can constitute filter rod sections of unit length or multiple unit length, and the articles of the series are or can be coaxial with each other.

The method can further comprise the steps of monitoring the length of the file and mechanically arresting the articles of the file when the monitored length is less than a predetermined (minimum acceptable) length.

Another feature of the invention resides in the provision of an apparatus for transporting rod-shaped articles of the tobacco processing industry axially between an article discharging station and a remote article receiving station. The apparatus comprises a pneumatic conveyor pipe defining an elongated path which extends from the discharging station to the receiving station, means for admitting into the path a series of successive articles at the discharging station and for pneumatically propelling the thus admitted articles along the path toward the receiving station so that the articles advance axially, means for influencing successive articles of the series in a first portion of the path so that each of the thus influenced articles advances toward the receiving station at a predetermined speed and the articles form a file of closely adjacent articles extending from the first portion of the path upstream toward the discharging station, and means for pneumatically accelerating successive articles of the file in a second portion of the path between the first portion and the receiving station so as to establish gaps between each of the thus accelerated articles and the next-following article.

The influencing means can comprise a housing which is sealed from the surrounding atmosphere and through which the conveyor pipe extends. The conveyor pipe has an opening in the interior of the housing, and the influencing means further comprises one or more friction wheels which are installed in the housing and extend into the first portion of the path through the opening of the conveyor pipe and means for driving the friction wheel or wheels at a peripheral speed which corresponds to the predetermined speed. The accelerating means preferably comprises means for admitting into the housing a compressed gaseous fluid at a predetermined pressure so that such fluid enters the conveyor pipe by way of the opening in the housing of the influencing means downstream of the location of engagement between the friction wheel or wheels and successive articles of the series.

The apparatus can further comprise a braking device including at least one braking member movable into a third portion of the path upstream of the first portion to arrest the oncoming article of the file in the elongated path. The braking member or members can comprise one or more brake shoes. Such apparatus preferably further comprises means for monitoring the length of the file of articles in the path and for generating signals when the monitored length of the file is less than a predetermined length, and means for moving the braking member or members into the third portion of the path in response to such signals.

The braking means can comprise an enclosure which is sealed from the surrounding atmosphere and receives the braking member or members. The conveyor pipe extends through such enclosure and has a second opening which enables the braking member or members to enter the third portion of the path. The aforementioned admitting means can comprise a conduit which connects the enclosure with the housing so that the compressed gaseous fluid which is used to accelerate successive articles of the file in the second portion of the path is that fluid which is used to propel the articles of the series from the discharging station toward the first portion of the path, i.e., the compressed gaseous fluid enters the housing of the influencing means after entering the enclosure of the braking means by way of the second opening in the conveyor pipe and after flowing through the conduit which connects the enclosure with the housing.

The receiving station preferably accommodates means for changing the direction of travel of successive accelerated articles from axial movement to a movement substantially at right angles to the axes of the articles.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The FIGURE is a schematic partly elevational and partly sectional view of an apparatus which embodies one form of the invention and wherein the influencing means comprises two friction wheels located downstream of a brake shoe which forms part of the braking means.

DESCRIPTION OF THE PREFERRED EMBODIMENTS

Referring to the drawing in detail, the improved apparatus comprises a device 1 which admits successive rod-shaped articles 4 of a series of such articles into the inlet of a pneumatic conveyor pipe 3 at an article discharging station A. The pipe 3 connects the station A with an article receiving station B which accommodates a device 2 for changing the direction of movement of successive articles 4 from axial movement to a movement at right angles to the axes of the respective articles. Devices which can be used at the receiving station B are disclosed, for example, in commonly owned U.S. Pat. No. 3,608,972 granted Sept. 28, 1971 to Rudszinat, in commonly owned U.S. Pat. No. 4,372,710 granted Feb. 8, 1983 to Kasparek et al. and in German Offenlegungsschrift No. 2 306 096. Devices which can be used to admit successive rod-shaped articles 4 into the inlet of the conveyor pipe 3 at the station A are disclosed, for example, in U.S. Pat. No. 3,397,922 granted Aug. 20, 1968 to Dearsley, in U.S. Pat. No. 3,404,921 granted Oct. 8, 1968 to Vergales et al. and in U.S. Pat. No. 3,062,588 granted Nov. 6, 1962 to Molins et al. The articles 4 can constitute sections or stubs of filter rods which are to be transported from a magazine or from a maker to a processing machine, e.g., into the magazine of a filter tipping machine of the type known as MAX or MAX S (both manufactured and sold by the assignee of the present application).

In accordance with a feature of the invention, the improved apparatus further comprises a mechanical article influencing unit 6 which is adjacent to a first portion of the path defined by the conveyor pipe 3. This unit comprises a housing 7 which is sealed from the surrounding atmosphere and through which the pipe 3 extends. The pipe 3 has an opening 3*a* (i.e., it is interrupted) in the interior of the housing 7 and this opening affords access for portions of two friction wheels 11, 12 forming part of a drive 9 and being driven by their respective shafts 11*a*, 12*a* so as to rotate at a predetermined peripheral speed corresponding to the desired speed of articles 4 which are to advance from the opening 3*a* toward the device 2 at the receiving station B. The direction in which the pneumatically propelled articles 4 approach the opening 3*a* and the friction wheels 11, 12 is indicated by the arrow 8. The influencing action of the friction wheels 11 and 12 upon successive articles 4 which arrive from the discharging station A is such that the articles are accelerated or decelerated (normally decelerated) to a predetermined speed and that they form a file F of articles extending from the opening 3*a* upstream toward the discharging station A. The illustrated friction wheels 11 and 12 are disposed diametrically opposite each other with reference to the axis of an article 4 therebetween; however, it is equally within the purview of the invention to employ a single friction wheel, to employ two friction wheels which are not positioned in a manner as shown in the drawing, or to employ three or more friction wheels.

The influencing unit 6 is located downstream of a braking unit 13 having a braking member 14 in the form of an elongated strip-shaped brake shoe which is reciprocable at right angles to the direction of advancement of articles 4 in the corresponding portion of the path and can reach the adjacent article or articles 4 through a second opening 16 provided in that portion of the pipe 3 which extends through an enclosure 17 for the braking member 14. The enclosure 17 is sealed from the surrounding atmosphere. The means for moving the braking member 14 into and away from arresting engagement with the adjacent article 4 comprises an electromagnet 23 which is energizable in response to signals from a monitoring unit 19 disposed adjacent to a further portion of the path for the articles 4 between the enclosure 17 and the article discharging station A. The pressure in the interior of the enclosure 17 matches that in the pipe 3 and its opening 16, and the enclosure 17 is connected with the housing 7 of the influencing unit 6 by a conduit 18 which admits compressed air into the housing 7 and into the inlet of that portion of the pipe 3 which extends from the housing 7 to the receiving station B.

The illustrated monitoring device 19 includes a source 21 of radiation at one side and a transducer 22 at the other side of that portion of the path for the articles 4 which extends between the components 21 and 22. The output of the transducer 22 transmits signals to the electromagnet 23 so as to move the braking member 14 into engagement with and to arrest the adjacent article or articles 4 when the length of the file of articles upstream of the housing 7 of the influencing unit 6 is reduced below a predetermined length. The radiation source 21 is assumed to emit visible light and, therefore, the adjacent portion 24 of the conveyor pipe 3 consists of a transparent or translucent material. The transducer 22 generates a signal which causes the electromagnet 23 to move the braking member 14 into engagement with the adjacent article or articles 4 whenever the beam or beams of light issuing from the source 21 are capable of reaching the light-sensitive surface of the transducer 22. The illustrated single braking member 14 (which extends longitudinally of the path for the articles 4 in the enclosure 17) can be replaced with two or even more braking members; all that counts is to ensure that the braking unit 13 is capable of arresting the adjacent article or articles 4 when the file of articles in the pipe 3 upstream of the housing 7 is too short. The conductor means for transmission of signals from the transducer 22 to the electromagnet 23 is shown at 25.

The operation is as follows:

When the apparatus is started, the device 1 at the station A propels successive articles 4 of a series of such articles into the inlet of the pneumatic conveyor pipe 3 at a certain frequency, and such articles are advanced in the pipe 3 axially toward the station B by compressed air which is supplied by the device 1. When the apparatus is started, the braking member 14 extends into the opening 16 because, at such time, the monitoring device 19 indicates the absence of articles 4 between the light source 21 and the transducer 22. The articles 4 pile up behind the braking member 14 to form a growing file whose trailing end ultimately reaches the monitoring device 19 whereby the latter actuates (energizes or deenergizes) the electromagnet 23 so that the braking member 14 is retracted from the opening 16 and allows successive articles 4 to advance toward and into the housing 7. Such articles are influenced by the driven friction wheels 11 and 12 of the unit 6 so that their speed is reduced or increased to a predetermined speed which is determined by the selected speed of the prime mover which drives the shafts 11*a* and 12*a*. It is presently preferred to select the peripheral speed of the friction wheels 11 and 12 in such a way that it exceeds the average speed of the articles 4. The average speed is determined by the frequency at which the articles 4 are propelled by the device 1 at the article discharging station A and by the length of the articles. This ensures that the force of impact of a pneumatically propelled article 4 against the last article of the file upstream of the housing 7 is greatly reduced so that the energy which an oncoming pneumatically propelled article transmits to the file of articles upstream of the housing cannot adversely affect the action of the friction wheels 11 and 12 upon the article therebetween. In other words, the just discussed selection of the peripheral speed of the friction wheels 11 and 12 ensures that the influencing unit 6 can advance successive articles 4 of the file at a speed which is identical with or is properly related to the peripheral speed of the friction wheels. Thus, each article 4 which advances beyond the first portion of the path (i.e., beyond the nip of the friction wheels 11 and 12) moves axially at a predetermined speed and enters the portion of the pipe 3 between the housing 7 and the receiving station B. Each such article is immediately accelerated by the stream of compressed air which has entered the housing 7 via conduit 18 (i.e., from the portion of the pipe 3 which is located upstream of the opening 16) and reenters the pipe 3 via opening 3*a* in the interior of the housing 7. The accelerating action of the stream of compressed air is selected in such a way that the article 4 which leaves the housing 7 is accelerated relative to the next-following article and such articles form a gap whose width suffices to ensure that the device 2 can change the orientation of successive articles 4 without any interference on the part of the next-following articles. If the pressure in the conduit 18 does not suffice to effect such singularization of articles 4 downstream of the nip of the friction wheels 11 and 12, the pressure in the interior of the housing 7 can be raised above that in the conduit 18.

If the length of the file of articles 4 upstream of the housing 7 is reduced below that which is necessary to prevent the transducer 22 from initiating the movement of the braking member 14 into the opening 16 and into engagement with the adjacent article or articles, the monitoring device 19 causes the electromagnet 19 to move the member 14 against and to arrest the adjacent article or articles 4 in the enclosure 17. Such situation can arise when the frequency at which the device 1 propels articles 4 into the pipe 3 fluctuates, when the device 1 is out of commission or when the device 1 is arrested or its speed reduced for another reason. This ensures that a pneumatically propelled article 4 cannot strike against the trailing end of the last article of the file with an excessive force such as could affect the action of the friction wheels 11 and 12. When the braking member 14 is in engagement with the adjacent article or articles 4, that portion of the pipe 3 which is located downstream of the enclosure 17 is substantially sealed from the portion of the pipe upstream of the enclosure 17. In order to ensure that the apparatus can be started without much delay after the electromagnet 23 is caused to retract the braking member 14, the apparatus comprises the aforementioned conduit 18 which connects the enclosure 17 with the housing 7. The braking member 14 is dimensioned and positioned in such a way that it allows the flow of compressed air from the upstream portion of the pipe 3 into the enclosure 17 and thence into the housing 7 via conduit 18. Thus, when the monitoring device 19 causes the electromagnet 23 to extract the braking member 14 from the opening 16 of the pipe 3, i.e., when the length of the file of articles 4 upstream of the housing 7 matches or exceeds the minimum permissible or acceptable length, the apparatus is ready to proceed with the acceleration of successive articles which have been moved beyond the nip of the friction wheels 11 and 12.

The improved apparatus can also be used for an additional purpose. Thus, when the pipe 3 is very long and includes one or more arcuate portions, the articles 4 in such long or very long pipe are likely to accumulate into one or more long files (the so-called D-trains) which advance at a relatively low speed and constitute obstructions for the remaining articles which advance at the prescribed speed. In order to break up such long files of articles, the influencing unit 6 can be used independently of the braking unit 13 and monitoring unit 19 and is installed at a selected location along the path which is defined by the pipe 3 to break up the D-trains. Two or more units 6 can be installed adjacent to a single pipe 3 if the latter is very long or is configurated in such a way that D-trains are likely to develop in two or more portions of the path of articles from the article discharging to the article receiving station. Those portions of the path which is defined by a long pneumatic conveyor pipe wherein D-trains are likely to develop are known to the persons in charge so that the influencing unit or units 6 which are provided to break up D-trains can be properly installed at the strategic location or locations between the two stations. The friction wheels 11, 12 of such influencing unit or units 6 are driven at a peripheral speed which exceeds the speed of the D-train or D-trains. Therefore, the articles which form the D-trains are accelerated, first mechanically and immediately thereafter pneumatically in the aforedescribed manner, to ensure reliable and rapid singularization of the articles. It has been found that the improved influencing unit is capable of rapidly and reliably eliminating D-trains so that they cannot interfere with the advancement of other articles at the prescribed (optimum) speed.

An important advantage of the improved method and apparatus is that they effectively and reliably prevent damage to the articles in the pipe 3. Thus, by properly selecting the peripheral speed of the friction wheels 11 and 12, it is possible to ensure that the atticles of the file which accumulates upstream of the housing 7 of the influencing unit 6 advance at a speed which is sufficiently high to prevent an article that is being propelled by the device 1 from striking the immediately preceding article (last article of the file) with a force which could cause damage to the respective articles. Moreover, the peripheral speed of the friction wheels 11 and 12 can be readily selected with a view to ensure the establishment of optimum gaps between successive articles 4 which are accelerated by compressed air flowing from the housing 7, through the opening 3*a* and into that portion of the pipe 3 which connects the housing 7 with the device 2 at the receiving station B. The likelihood of damage to articles 4 in the pipe 3 is reduced still further if the articles of the aforementioned series and file are coaxial with each other. This ensures that the entire front end face of the leader of an oncoming article strikes against the entire rear end face of the preceding article; such engagement between neighboring articles is less conductive to deformation of and/or other damage to the articles in the pipe 3.

Another important advantage of the improved apparatus is that the unit 6 can serve as a means for mechanically influencing (accelerating or braking) successive articles 4 and also as a means for pneumatically accelerating the mechanically influenced articles to effect a desirable singularization of articles upstream of the receiving station B.

Still another important advantage of the improved apparatus is its versatility. Thus, and as explained above, the unit 6 can be used in conjunction with the braking unit 13 and the monitoring unit 19 or independently of the units 13 and 19 as a means for breaking up D-trains, i.e., accumulations of one or more long files of articles which advance at less than the prescribed speed and interfere with the progress of remaining articles on their way to the receiving station B.

The braking unit 13 is idle when the apparatus operates in the prescribed way, i.e., when the device 1 at the article discharging station A propels the articles 4 at the desired frequency. However, the braking unit 13 becomes effective in automatic response to detection of insufficient accumulations of articles upstream of the influencing unit 6. The distance between the braking unit 13 and the monitoring unit 19 as well as between the braking unit and the influencing unit 6 can be selected with a view to ensure the accumulation of a requisite file of articles upstream of the housing 7, and each of these distances can be varied within a desired range.

A braking member 14 in the form of a brake shoe is preferred at this time because it is capable of engaging the adjacent article or articles gently so that such articles are not subjected to excessive deforming stresses but are held firmly against axial movement beyond the braking station as long as the electromagnet 23 causes the braking member 14 to extend into the opening 16.

Still another advantage of the improved apparatus is that the articles 4 are accelerated pneumatically immediately downstream of the nip of the friction wheels 11 and 12 so that they are even less likely to be deformed or otherwise damaged. Moreover, the acceleration of articles downstream of the nip of the friction wheels 11 and 12 normally does not require the provision of a separate source of compressed gaseous fluid because the conduit 18 delivers compressed air from an upstream portion of the pipe 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of transporting rod-shaped articles of the tobacco processing industry axially between an article discharging station and an article receiving station along an elongated path which is defined by a pneumatic conveyor, comprising the steps of propelling a series of successive articles from the discharging station into the elongated path; mechanically influencing the speed of successive articles of said series in a first portion of said path ahead of the receiving station so that each of the thus influenced articles advances at a predetermined speed and the articles form a file of closely adjacent articles extending from said first portion upstream toward said discharging station; pneumatically accelerating successive foremost articles of the file in a second portion of said path between said first portion and said receiving station so as to establish gaps between successive accelerated articles and the next-following articles of the file; monitoring the length of the file; and mechanically arresting the articles of such file when the monitored length is less than a predetermined length.

2. The method of claim 1, wherein said influencing step includes decelerating successive articles of the series.

3. The method of claim 1, wherein the articles are filter rod sections.

4. The method of claim 1, wherein the articles of the series are coaxial with each other.

5. Apparatus for transporting rod-shaped articles of the tobacco processing industry axially between an article discharging station and an article receiving station, comprising a pneumatic conveyor defining an elongated path extending from said discharging to said receiving station; means for admitting into said path a series of successive articles at said discharging station and for pneumatically propelling the thus admitted articles along said path toward said receiving station; means for influencing successive articles of the series in a first portion of said path so that each of the thus influenced articles advances toward said receiving station at a predetermined speed and the articles form a file of closely adjacent articles extending from said first portion of said path upstream toward said discharging station; means for pneumatically accelerating successive articles of the file in a second portion of said path between said first portion and the receiving station so as to establish gaps between each of the thus accelerated articles and the next-following article; means for monitoring the length of the file in said path and for generating signals when the monitored length of the file is less than a predetermined length; a braking member movable into a third portion of said path upstream of said first portion to arrest the oncoming article of the file; and means for moving said braking member into said third portion of said path in response to said signals.

6. The apparatus of claim 5, wherein said influencing means comprises a housing which is sealed from the atmosphere and through which said conveyor extends, said conveyor having an opening in the interior of said housing and said influencing means further comprising at least one friction wheel extending into said first portion of said path by way of said opening and means for driving said friction wheel at a peripheral speed corresponding to said predetermined speed.

7. The apparatus of claim 6, wherein said influencing means comprises a plurality of friction wheels.

8. The apparatus of claim 6, wherein said accelerating means includes means for admitting into said housing a compressed gaseous fluid at a predetermined pressure so that such fluid enters said conveyor by way of said opening downstream of the location of engagement between said friction wheel and successive articles of said series.

9. The apparatus of claim 5, wherein said braking member includes at least one shoe.

10. The apparatus of claim 5, wherein said influencing means comprises a housing which is sealed from the atmosphere and through which said conveyor extends, said conveyor having an opening in the interior of said housing and said influencing means further comprising at least one friction wheel extending into said first portion of said path by way of said opening and means for driving said friction wheel at a peripheral speed corresponding to said predetermined speed, said accelerating means including means for admitting into said housing a compressed gaseous fluid at a predetermined pressure so that such fluid enters said conveyor by way of said opening downstream of the location of engagement between said friction wheel and successive articles of the series, said admitting means comprising a conduit connecting said housing with said path upstream of said first portion of said path.

11. The apparatus of claim 10, further comprising an enclosure which is sealed from the atmosphere and through which said conveyor extends, said conveyor having a second opening in the interior of said enclosure and said braking member being installed in said enclosure and being movable into the third portion of said path by way of said second opening, said conduit connecting the interior of said enclosure with the interior of said housing so that the opening in said housing receives compressed gaseous fluid from said conveyor by way of said second opening and said enclosure.

12. The apparatus of claim 5, further comprising means at said receiving station for changing the direction of movement of successive accelerated articles from axial movement to a movement substantially at right angles to the axes of the articles.

* * * * *